United States Patent [19]

Breitenstein

[11] Patent Number: 5,044,585

[45] Date of Patent: Sep. 3, 1991

[54] BAG HOLDER

[76] Inventor: George T. Breitenstein, 4965 South Shore Drive, New Port Richey, Fla. 34652

[21] Appl. No.: 417,648

[22] Filed: Oct. 5, 1989

[51] Int. Cl.[5] ..... B65B 67/00

[52] U.S. Cl. ..... 248/100; 294/170

[58] Field of Search ..... 248/95, 97, 98, 99, 248/100, 101; 220/404; 294/170; 312/320

[56] References Cited

U.S. PATENT DOCUMENTS

| | | | |
|---|---|---|---|
| D. 137,712 | 4/1944 | Miano | 294/170 X |
| 736,630 | 8/1903 | Peiddat | 294/170 |
| 3,175,793 | 3/1965 | Kennedy | 248/99 |
| 3,646,723 | 3/1972 | Meroney | 248/100 X |
| 3,819,089 | 6/1974 | Scales | 248/95 X |
| 4,841,596 | 6/1989 | Fink | 294/170 X |

FOREIGN PATENT DOCUMENTS

| | | | |
|---|---|---|---|
| 2541099 | 8/1984 | France | 294/170 |
| WO81/03008 | 10/1981 | PCT Int'l Appl. | 294/170 |
| 153190 | 1/1956 | Sweden | 294/170 |

*Primary Examiner*—David L. Talbott

[57] ABSTRACT

A bag holder for use with a bag having at least one hand grip, which comprises an elongated body having a first end, a mid-portion and a second end with a tongue positioned at the mid-portion of the body for securing the bag holder to a nail body or the like, a cabinet door handle, an edge of a door/drawer, a side of a door, a shelf edge or the like, to securely hold a bag while maintaining the bag in an open position in order to permit easy access to the interior of the bag for placement of objects into the bag. A first and a second bag grip receiving means are positioned at the first and the second end, respectively, of the elongated body to securely and supportingly receiving the hand grip of a bag thereby supporting the bag and any objects therein.

8 Claims, 4 Drawing Sheets

FIG. 5
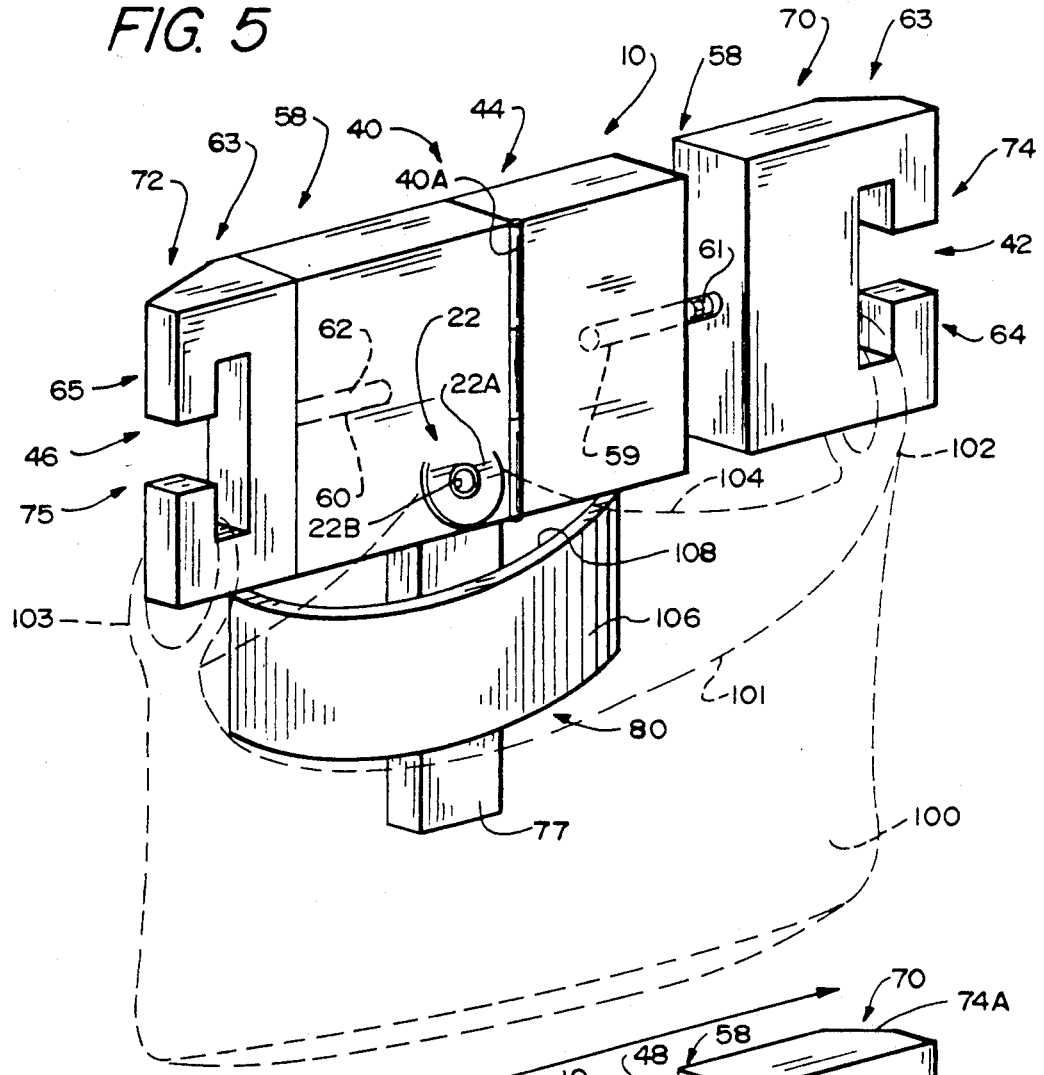
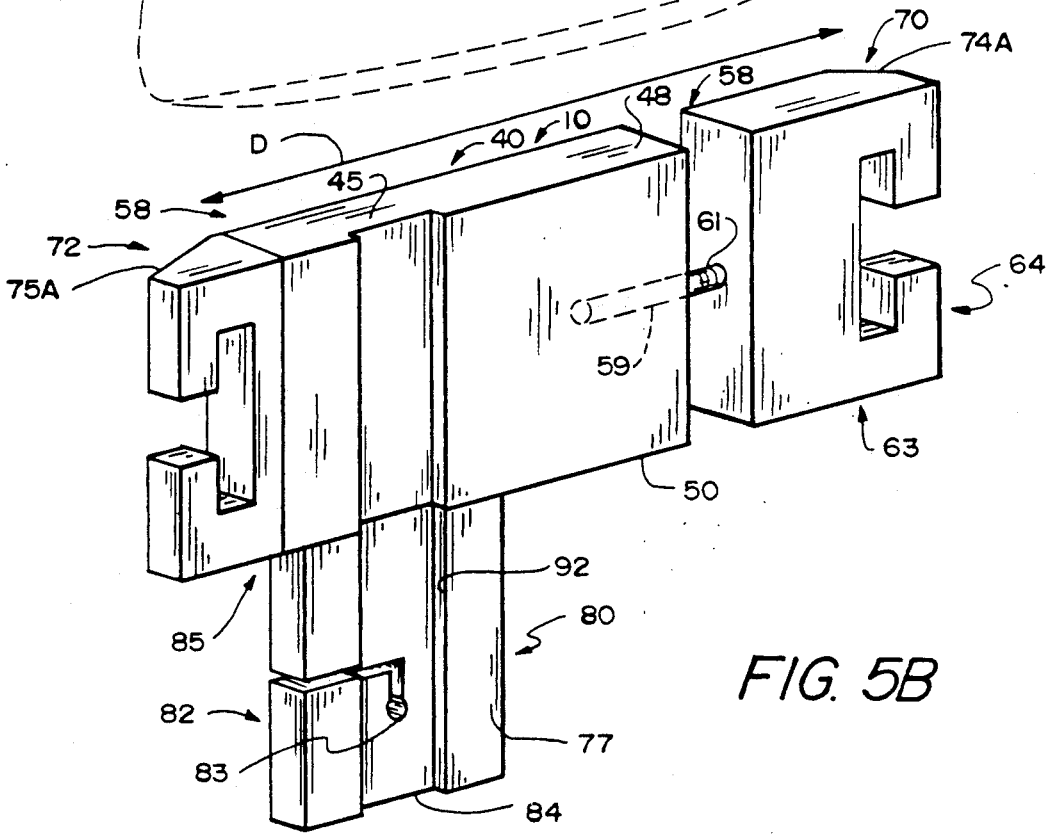
FIG. 5B

BAG HOLDER

BACKGROUND OF THE INVENTION

Field of the Invention

This invention relates to holding device for a bag provided with at least one handle or hand grip, and more particularly, to a device to enable a cabinet door handle, a top edge of a door/drawer, a side edge of a door, a shelf edge, or the like, or a nail body, or the like, to securely hold a bag while maintaining the bag in an open position in order to permit easy access to the interior of the bag for placement of objects into the bag.

The prior art is replete with holders which fail to adequately provide a holder which for use with a cabinet door handle, a door edge, a shelf edge or the like. Further, the prior art devices fail to ensure that the opening of the bag is maintained in an open position to aid in the placement of objects into the bag while the bag is attached to the prior art device.

Therefore, it is an object of this invention to provide a bag holder which is readily and easily adaptable for use with nail or the like secured in a vertical surface, a cabinet drawer/door handle, an edge of a door/drawer, a side of a door, or a shelf edge, and the like.

It is a further object of this invention to provide a bag holder which ensures that the opening of the bag is maintained in an open position thereby aiding in the placement of objects into the bag.

It is a further object of this invention to provide a bag holder which may be placed flat against a vertical surface yet allow the grips of the bag to be easily secured to the holder.

It is a further object of this invention to provide a bag holder which is economical to produce.

It is a further object of this invention to provide a bag holder which does not require modification of the cabinet drawer/door handle to obtain optimum use.

It is a further object of this invention to provide a bag holder which provides a plurality of different and interchangeable tongues to enable the positioning of the holder at different locations It is a further object of this invention to provide a bag holder with a closing means for closing the opening to the interior of the bag thereby ensuring to aid in the prevention of odors eminating from the contents of the bag and to prevent the invasion of insects into the interior of the bag.

It is a further object of this invention to provide a bag holder with a receiving means which secures a bag to the holder notwithstanding the secured position of the holder, i.e. a horizontal position, a vertial position or an angled position inbetween.

The foregoing has outlined some of the more pertinent objects of the present invention. These objects should be construed to be merely illustrative of some of the more pertinent features and applications of the invention. Many other beneficial results can be obtained by applying the disclosed invention is a different manner or modifying the invention within the scope of the disclosure. Accordingly, other objects and a fuller understanding of the invention may be had by referring to the summary of the invention and the detailed describing the preferred embodiment in addition to the scope of the invention defined by the claims taken in conjunction with the accompanying drawings.

SUMMARY OF THE INVENTION

The bag holder of the present invention is defined by the appended claims with a specific embodiment shown in the attached drawings. For the purpose of summarizing the invention, the invention relates to bag holders for use with a bag having at least one hand grip for cooperation with an edge of a shelf, an edge/side of a door, an edge of a drawer, a handle of a cabinet, or the like; or a nail body, or the like, secured to a wall. The cabinet door handle, top edge of a door/drawer, side edge of a door, shelf edge, or other attachment points found on a cabinet, or the like, are collectively referred to as a "cabinet surface."

A first embodiment of the bag holder comprises a resilient body having a first end and a second end with an aperture formed between the first end of the resilent body and the second end of the resilient body to enable the resilient body to grippingly receive therethrough a cabinet door handle to secure the holder to the handle. A first and a second bag grip receiving means are positioned at the first and the second end, respectively, of the resilient body for securely and supportingly receiving the hand grip of the bag. A means for frictionally engaging the cabinet door handle aids in retaining the bag holder when the bag holder is received onto the cabinet door handle. The means for frictionally engaging the cabinet door handle preferably comprise a plurality of bosses extending in use to engage the cabinet door handle as the bag holder is being moved off the cabinet door handle to thereby prevent unintended removal of the bag holder from the cabinet door handle. Preferably, the resilient body further includes a mid-portion which includes a notch formed thereat to receive in use a shaft of a handle or nail body or shaft to permit the holder to hang from the shaft thereby securing the bag holder to the handle or shaft to permit the placement of objects into the bag holder. The bag holder may further include a mid-bag securing means positioned at the mid-portion of the resilient body for holding a portion of the bag in the same horizontal plane as the hand grips of the bag such that in use the front portion of the bag is held in a more open position to facilite the placing of objects therein. That is, the mid-bag securing means enables the back portion of the bag to be secured which allows the front portion of the bag to hang down and open. This makes the location of the interior of the bag open and ready for the placement of objects therein.

Another embodiment of the bag holder comprises an elongated body having a first end, a mid-portion and a second end with a tongue positioned at the mid-portion of the body for securing the bag holder a cabinet surface or nail body, or the like, secured to a wall. A first and a second bag grip receiving means are positioned at the first and the second end, respectively, of the elongated body to receive and secure the hand grips of the bag to the elongated body thereby supporting the bag through the cabinet surface or nail body.

Preferably, the tongue has one of the following shapes: a "C" shape in order to receive in use a front edge of a shelf, or the like, thereby securing the holder to the shelf; a "L" shape in order to receive in use a top edge of a door/drawer, the side of a door, or the like, thereby securing the holder to the door/drawer; or a flat shape in order to be received in use by a finger opening of a handle secured to the cabinet thereby securing the holder to the cabinet. The designation of the tongues as "C" shape and "L" shape is a matter of convenience since both include a "C" shape with the difference being in the point of attachment. Where the tongue is an extension of a horizontal leg of the letter "C" it is considered a "L" shape. Where the holder is attached to one of the legs, the tongue is considered to be a "C" shape. Whereas, where the tongue is an extension from the vertical portion of the letter "C", it is considered a "C" shape. Where the tongue is "C" shaped, the tongue may further include a rotating means to enable the elongated body to be pivoted to a horizontal position when the tongue is attached to the side of a door, or the like. Each tongue may further include a hanging means, preferably, a hooked shaped notch formed in the tongue, for securing the bag holder to the shaft of a handle, or a nail body, so as to include a nail, screw, or the like, partially driven into a wall. Preferably, the flat shape tongue includes a hooked shaped notch formed therein. The flat shape tongue includes a "V" shape with the apex including a hanging means. Where the "V" is formed from wire, the apex of the "V" forms the hanging means. The "L" and "C" shaped tongues may include a clamping means to fasten the tongue to the door, shelf, etc., to prevent movement of the holder during use.

Preferably, the bag holder includes a tongue adjusting means to enable the tongue to be axially moved between the first end of the elongated body and the second end of the elongated body to enable the elongated body to be positioned away from an adjacent cabinet door such that the adjacent cabinet door may be opened or closed without interference from the bag holder or from a walkway where the elongated body would otherwise intrude. This aspect is especially advantageous for the "C" and "L" shaped tongues. The tongue adjusting means includes a rail formed on any of the above tongues. The rail slidably fastens into a channel formed in the elongated body thereby permitting axial movement of the tongue between the first end and the second end of the elongated body. Also, since the tongue is removable, it can be turned around relative to the face of the elongated body to enhance the use of the holder. Preferably, the elongated body includes a top and a bottom with at least the top or the bottom of the elongated body including a channel formed thereat to securingly receive the rail therein.

An extending means of the holder enables the first bag grip receiving means to move axially relative to the second bag grip receiving means such that in use when a first hand grip of the bag is received by the first bag grip receiving means and a second hand grip of the bag is received by the second bag grip receiving means, the distance separating the first and the second bag grip receiving means may be varied to maintain the opening of the bag in an open position to facilitate the placing of objects therein and to accommodate in use different sizes of bags. The extending means includes a first and a second threaded bore formed in the first side and second side, respectively, of the elongated body to receive a first and a second threaded shaft therein wherein the first and the second threaded shaft each include a terminal end having the first and the second bag grip receiving means attached thereat, respectively. This enables a infinite variation in the distances between the first and second bag grip receiving means.

The first and second bag grip receiving means preferably each define a first the a second center-opened slot, respectively, to grippingly receive in use a portion of the hand grip of the bag. Preferably, each of the first and second center-opened slots are offset to enable the passage of the respective bag grip into the respective center-opened slot when the bag holder is placed flat against a vertical surface, such as a wall or door.

In another embodiment of the invention the elongated body is an arc shaped bar having a first end, a mid-line and a second end. Preferably, the arc shaped bar includes a pivoting means for enabling the arc shaped bar to pivot relative to the tongue such that in use the arc shaped bar is in a horizontal position to aid in maintaining the bag in an open position to facilitate the placing of objects therein and to allow the arc shaped bar to be pivoted to a vertical position to decrease the intrusion of the arc shaped bar into the workplace and to aid in retaining the objects placed into the bag. Preferably, the pivoting means is a spring secured to the tongue and the bar and biases the bar in a vertical position.

The bag holder for use with a bag having at least on hand grip preferably comprises the combination•of an elongated body having a first end, a mid-portion and a second end and includes a top and a bottom. A first and a second bag grip receiving means for securely and supportingly receiving a first hand grip and a second hand grip, respectively, of the bag are positioned at the first and the second end, respectively, of the elongated body. An extending means enables the first bag grip receiving means to move axially relative to the second bag grip receiving means such that in use when the first hand grip of the bag is received by the first bag grip receiving means and the second hand grip of the bag is received by the second bag grip receiving means the distance separating the first and the second bag grip receiving means may be varied to maintain the opening of the bag in an open position to facilitate the placing of objects therein and to accommodate in use different sizes of bags. A "L" shaped tongue is positioned at the mid-portion of the elongated body with the "L" shaped tongue being configured such that in use the top edge of the cabinet, such as the edge of a door, drawer or the like, is securingly received thereby, to attach the bag holder to the cabinet, or the like. The holder may be positioned or hung downwardly or supported in an upward position when secured to the top edge. However, the holder may be supported upwardly when secured to the bottom edge of a drawer, and the like, in which case the tongue includes a clamping means, such as a clamp to secure the tongue to the drawer. The center-opened slot is operable from either of the above positions. The foot of the "L" shaped tongue may also be secured to a horizontal surface, such as a desk top, and the like. In this position, bags may be hung from the front and back of the elongated body to enable the separation of refuse and greater collection volume. A channel is formed in the bottom of the elongated body and the "L" shaped tongue further includes a rail to enable the "L" shaped tongue to be slidably received into the channel formed in the bottom of the elongated body. This enables the tongue to be securely positioned in the bottom of the elongated body and permits axial movement of the tongue between the first end the the second end of the elongated body to enable the elongated body to be positioned away from an adjacent cabinet door such that the adjacent cabinet door may be opened or closed without interference from the bag holder.

The bag holder for use with a bag having at least one hand grip also preferably comprises the combination of an elongated body having a first end, a mid-portion and a second end and which includes a top and a bottom and of a first and a second bag grip receiving means securely and supportingly receive a first and a second hand grip of a bag positioned at the first and the second end, respectively, of the elongated body. An extending means enables the first bag grip receiving means to move axially relative to the second bag grip receiving means such that in use when the first hand grip of the bag is received by the first bag grip receiving means and the second hand grip of the bag is received by the second bag grip receiving means the distance separating the first and the second bag grip receiving means may be varied to maintain the opening of the bag in an open position to facilitate the placing of objects therein and to accommodate in use different sizes of bags. A "C" shaped tongue is positioned at the mid-portion of the elongated body with the "C" shaped tongue being configured such that in use a front shelf edge of the cabinet is securingly received thereby, to attach the bag holder to the cabinet. A channel is formed in the bottom of the elongated body. The "C" shaped tongue further includes a rail formed thereon to enable the "C" shaped tongue to be slidably received into the channel formed in the bottom of the elongated body to securely position the tongue in the bottom of the elongated body and to permit axial movement of the tongue between the first end the the second end of the elongated body to enable the elongated body to be positioned away from an adjacent cabinet door such that the adjacent cabinet door may be opened or closed without interference from the bag holder.

The bag holder for use with a bag having at least one hand grip also preferably comprises the combination of an elongated body having a first end, a mid-portion and a second end which includes a top and a bottom and of a first and a second bag grip receiving means securely and supportingly receive the hand grip of the bag positioned at the first and the second end, respectively, of the elongated body. An extending means enables the first bag grip receiving means to move axially relative to the second bag grip receiving means such that in use when the first hand grip of the bag is received by the first bag grip receiving means and the second hand grip of the bag is received by the second bag grip receiving means the distance separating the first and the second bag grip receiving means may be varied to maintain the opening of the bag in an open position to facilitate the placing of objects therein and to accommodate in use different sizes of bags. A flat shaped tongue is positioned at the mid-portion of the elongated body. The flat shaped tongue has a flat shape which is receivable in use into a finger opening of a handle secured to the cabinet to thereby secure the holder to the cabinet. A channel is formed in the bottom of the elongated body. The flat shaped tongue further includes a rail formed thereon to enable the flat shaped tongue to be slidably received into the channel formed in the bottom of the elongated body to thereby securely position the tongue in the bottom of the elongated body and to permit axial movement of the tongue between the first end the the second end of the elongated body to enable the elongated body to be positioned away from an adjacent cabinet door such that the adjacent cabinet door may be opened or closed without interference from the bag holder.

The bag holder for use with a bag having at least one hand grip also preferably comprises the combination of an arc shaped bar having a first end, a mid-line and a second end with a tongue positioned at the mid-line of the bar for securing the bag holder to a cabinet and of a first and a second bag grip receiving means for securely and supportingly receive the first and second hand grips of the bag with the first and the second bag grip receiving means being positioned at the first and the second end, respectively, of the arc shaped bar. An extending means enables the first bag grip receiving means to move axially relative to the second bag grip receiving means such that in use when the first hand grip of the bag is received by the first bag grip receiving means and the second hand grip of the bag is received by the second bag grip receiving means the distance separating the first and the second bag grip receiving means may be varied to maintain the opening of the bag in an open position to facilitate the placing of objects therein and to accommodate in use different sizes of bags. A pivoting means enables the arc shaped bar to pivot relative to the tongue such that in use the arc shaped bar is in a horizontal position to aid in maintaining the bag in an open position to facilitate the placing of objects therein and to allow the arc shaped bar to be pivoted to a vertical position to decrease the intrusion of the arc shaped bar into the workplace and to aid in retaining the objects placed into the bag. A tongue adjusting means enables the tongue to be axially moved relative to the first end of the bar to enable the bar to be positioned away from an adjacent cabinet door such that the adjacent door may be opened or closed without interference from the bag holder. Preferably, the tongue may be flat shaped, "L" shaped or "C" shaped.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 5 is an isometric view of another embodiment of the invention;

FIG. 5B illustrates another embodiment of the invention;

Similar reference characters refer to similar parts throughout the several views of the drawings.

DETAILED DESCRIPTION OF THE DRAWINGS

Figure 1:
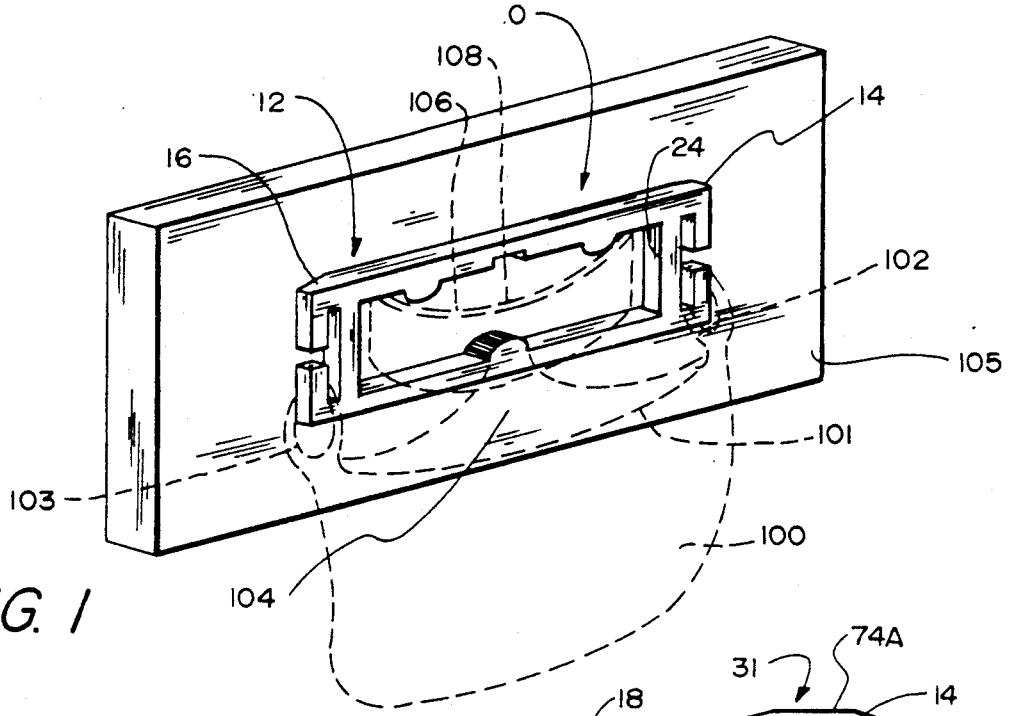
FIG. 1 is an isometric view of the holder according to the present invention in a working position.

FIG. 1 illustrates an isometric view of one embodiment of the present invention with the bag holder 10 secured to a cabinet shelf, drawer, door, or a handle affixed to the cabinet 105. A bag 100 with hand grips 102,103 is secured to holder 10 to enable the placement of objects, such as refuse, therein. Holder 10 comprises a resilient body 12 to enable it to be manipulated into a friction fit on handle 106. The resilient body 12 is formed from material which enables it to formingly receive the handle as see FIG. 1. A means 30 for frictionally engaging the cabinet door handle 106 aid in retaining the bag holder 10 in use on the cabinet door handle 106 when the bag holder 10 is received onto the cabinet door handle 106. The body 12 is preferably held fast to the handle by means 30 such as the plurality of bosses 31. The holder 10 includes a first end 14 and a second end 16 with an aperture 24 formed between the first 14 end of the body 12 and the second end 16 of the body 12 to enable the resilient body to grippingly receive therethrough a portion of the cabinet door handle 106. A first 70 and a second 72 bag grip receiving means securely receive the hand grips 102,103 of the bag 100 positioned at the first 14 and the second 16 end, respectively, of the resilient body 12. The first and second bag grip receiving means provide the only support for the bag such that in use the bag is secured and supported notwithstanding whether the securing position of the holder is in a hanging position (FIG. 4) or in a "held" position (FIG. 1). Preferably, the first and second bag grip receiving means define a first 74 and a second 75 center-opened slot, respectively, to grippingly receive in use a portion of the hand grip 102,103 of the bag 100. Preferably, the first and second center-opened slots are offset or chamfered 74A,75A, respectively, to permit entry of the hang grips into each respective slot when the holder is tightly positioned against a flat surface. The legs 74B,75C and 75B,75C of the open slots 74,75 respectively, are preferably configured to provide a narrow gap 74D,75D, respectively, thereby requiring an intended passage of a portion of each respective hand grip of bag 100 into and out of the open slot thereby aiding in preventing inadvertent disengagement of the hand grip(s) from the holder during use.

Figure 4:
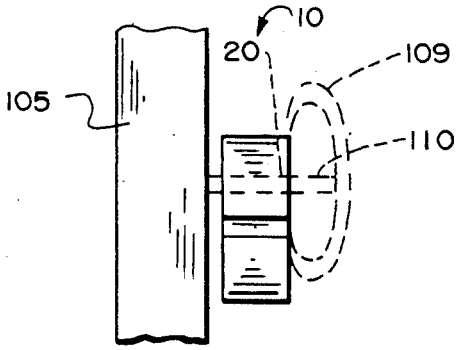
FIG. 4 is a side view illustrating the notch formed on the flat shaped tongue secured to a shaft of a cabinet handle thereby supporting the holder according to the present invention.

Preferably, the mid-portion 18 of the bag holder further includes a notch 20 formed thereat to receive in use a shaft 110, such as of the cabinet door handle 109. With the holder being resilient, it may be stretched over the handle 109 in order that the notch may be received by the shaft 110, as illustrated at FIG. 4.

Figure 2:
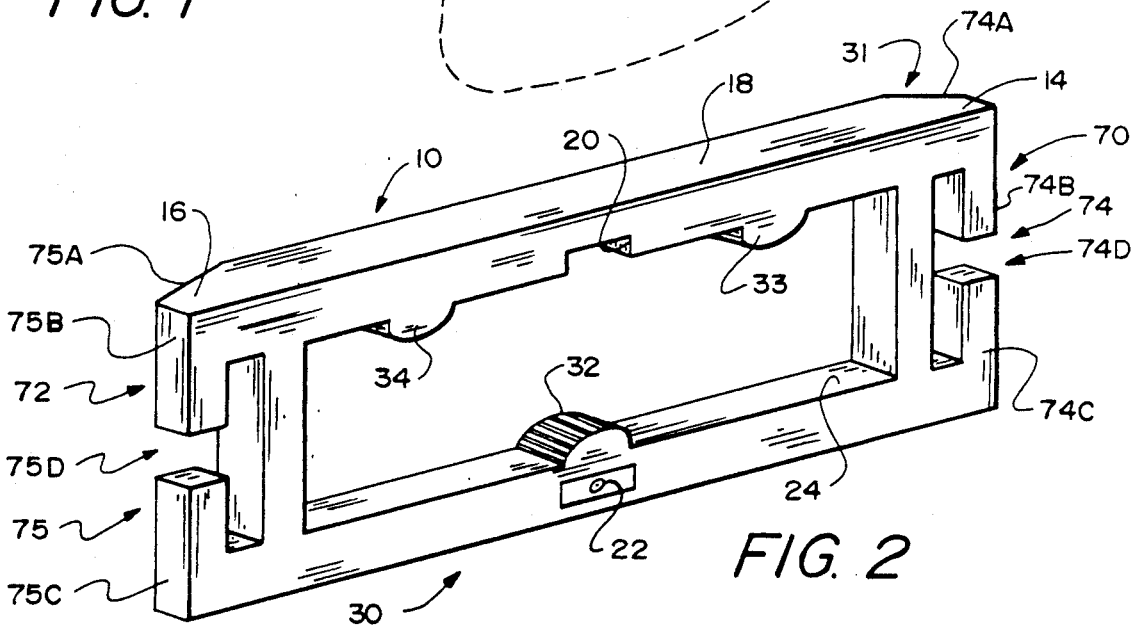
FIG. 2 is an enlarged view of the holder of the present invention.
Figure 3:
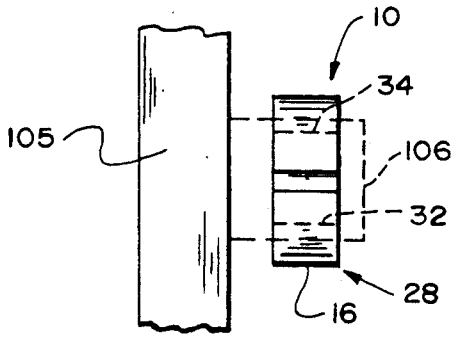
FIG. 3 is a partial side view illustrating the attachment of the holder to cabinet handle by the positioning of the handle within the aperture of the holder.

FIG. 2 is an enlarged view of the bag holder illustrating the means for frictionally engaging 30 the cabinet door handle 106 which comprises a plurality of bosses 31 extending in use to frictionally engage the cabinet door handle 106 or enter into the finger opening 108 to physically obstruct the removal of the bag holder 10 from the cabinet door handle 106 thereby preventing in use unintended removal of the bag holder from the cabinet door handle. The plurality of bosses 31 comprise a first boss 32, a second boss 33 and a third boss 34. FIG. 3 illustrates bosses 32 and 34 obstructing the removal of holder 10 from door handle 106 by being positioned within the finger opening 108 of the door handle 106 so as to be pressed against the inside of handle 106 during inadvertent removal. Holder 10 must be stretched to enable the bosses to pass over handle 106 when removal is desired.

The bag holder may further included a mid-bag securing means 22 positioned on the resilient body 12 for holding in use a back portion 104 of the bag 100 such that in use the bag is further held open to facilite the placing of objects therein as discussed above. That is, the mid-bag securing means 22 enables the back portion 104 of the bag 100 to be secured which allows the front portion 101 of the bag 100 to hang down relative to the back portion of the bag. This makes the location of the interior of the bag easier to access for the placement of objects therein.

FIG. 5 is an isometric view the second embodiment of the present invention with the bag holder 10 secured to a cabinet surface, namely a handle 106 affixed to the cabinet (not shown) with the bag holder 10 securing bag 100 with each hand grip 102,103 being received into the first 70 and a second 72 bag grip receiving means, respectively, positioned at the first 42 and the second 46 end, respectively of the elongated body 40. The first and second bag grip receiving means 70,72 provide the only support for the bag 100 such that in use the bag is secured and supported notwithstanding whether the securing position of the holder is in a hanging position (FIG. 7A) or in a "held" position (FIG. 5). That is the first and second bag grip receiving means secure and support the respective hand grip of the bag such that in use the bag is secured and supported when said holder is positioned in a plurality of positions. A bag 100 with hand grips 102,103 is secured to holder 10 to enable the placement of objects, such as refuse, therein. The holder 10 may be used in combination with a cabinet door 105 having a top edge 111 (FIG. 9), a shelf having an edge 112 (FIG. 8), a handle 106 having a finger receiving opening 108, a handle 109 having a shaft, or a nail body, so as to include a nail, screw, or the like, partially driven into a wall, or other vertical surface, as see FIG. 7A. Holder 10 comprises an elongated body 40 having a first end 42, a mid-portion 44 and a second end 46 with a tongue 77 having a straight or flat shape 80 positioned at the mid-portion 44 of the body 40. The flat shaped tongue 80 is slideably received in use into the finger opening 108 of the cabinet door handle 106 for securing the bag holder to the cabinet door. The first 70 and a second 72 bag grip receiving means secure the hand grip of the bag 100 positioned at the first 42 and the second 46 end, respectively of the elongated body. For convenience, the mid-portion 44 of the elongated body 40 preferably includes a hinge 40A positioned thereat to enable the first 42 end of the elongated body to be pivoted over to the second 46 end of the elongated body, thereby closing the opening of the bag to aid in the prevention of odors emanating from the contents of the bag and to prevent the invasion of insects into the interior of the bag. Preferably, a spring means (not shown) biases the first end 42 of the elongated body 40 against the second end 46 of the elongated body 40 to close the opening of the bag.

Figure 5A:
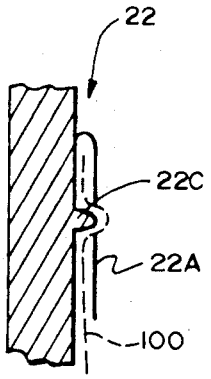
FIG. 5A illustrates the mid-bag securing means.

FIG. 5A illustrates the mid-bag securing means 22 positioned on the elongated body 40 for holding in use a back portion 104 of the bag 100 such that in use the bag is further held open to facilite the placing of objects therein as discussed above. That is, the mid-bag securing means 22 enables the back portion 104 of the bag 100 to be secured which allows the front portion 101 of the bag 100 to hang down relative to the back portion 104 of the bag. This makes the location of the interior of the bag easier to access for the placement of objects therein. Preferably, the mid-bag securing means is a flap 22A with an opening 22B formed therein to frictionally receive a portion of bag 100 and a protrusion 22C when the opening of the flap is frictionally received by the protrusion with the bag portion positioned therebetween.

Figure 7:
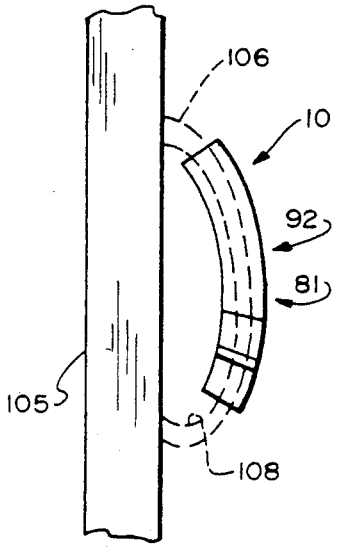
FIG. 7 is a side view illustrating the attachment of the holder by the groove of the holder received by the cabinet door handle.
Figure 7A:
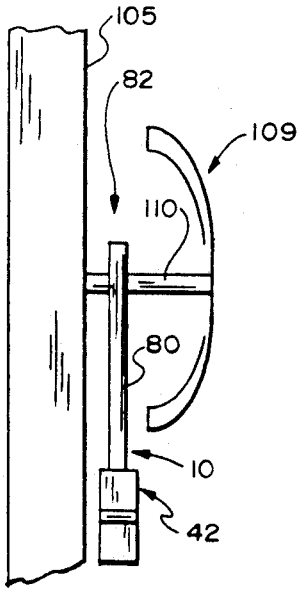
FIG. 7A illustrates the hanging means securing the holder to a nail body.

FIG. 5B further illustrates the second embodiment of the present invention. Preferably, the holder further includes a hanging means 82 for securing the bag holder to a handle 109 having a shaft 110, as shown at FIG. 7A, or just a shaft, such as shaft 110 without a handle portion such as 109, so as to include a nail partially driven into a wall or the like. Preferably, the hanging means is formed in the flat shaped 80 tongue 77. A hanging means may also be positioned at the top 48 of the elongated body 40. Preferably the hanging means is a hooked shaped opening 83 formed in the flat shaped 80 tongue 77. When the hanging means 82 is a hooked shaped opening 83 formed in the flat shaped tongue and which, in use, is positioned into the finger opening 108 of the handle 106 as illustrated at FIG. 5, the hooked shaped opening is able to function a bag holder since the hooked shaped opening can receive and least one hand grip, such as 102, of the bag 100.

FIGS. 5 and 5B also illustrate the extending means 58 of the holder 10. Preferably, the bag holder 10 includes an extending means 58 for enabling the first bag grip receiving means 70 to move axially relative to the elongated body 40 such that in use when the first hand grip of the bag 102 is received by the first bag grip receiving means 70 and the second hand grip of the bag 103 is received by the second bag grip receiving means 72 the distance, "D", separating the first and the second bag grip receiving means may be varied to maintain in use the opening of the bag in an open position to facilitate the placing of objects therein and to accommodate different sized bags. Most preferably, the extending means 58 includes a first 59 and a second 60 threaded bore formed in the elongated body 40 to receive a first 61 and a second 62 threaded shaft therein wherein the first 61 and the second 62 threaded shaft each include a terminal end 63 having the first 64 and the second 65 bag grip receiving means attached thereat, respectively. The use of the threaded arrangement described above enables the acceptance of a wide range of bag sizes and also enables the user to allow the front portion 101 of the bag 100 to hang down especially in combination with the mid-bag securing means 22.

Figure 6:
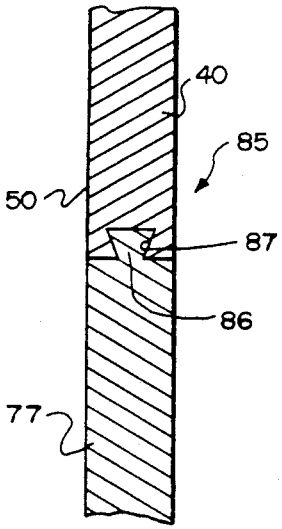
FIG. 6 illustrates the tongue attachment means.
Figure 8:
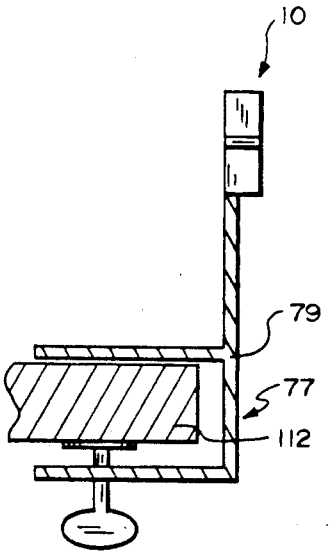
FIG. 8 illustrates the "C" shaped tongue.
Figure 9:
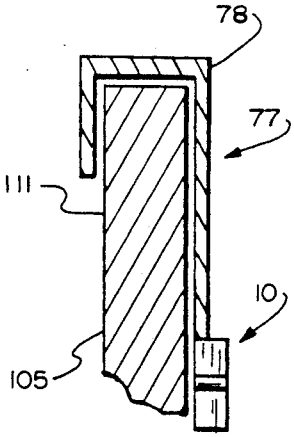
FIG. 9 illustrates the "L" shaped tongue.
Figure 12:
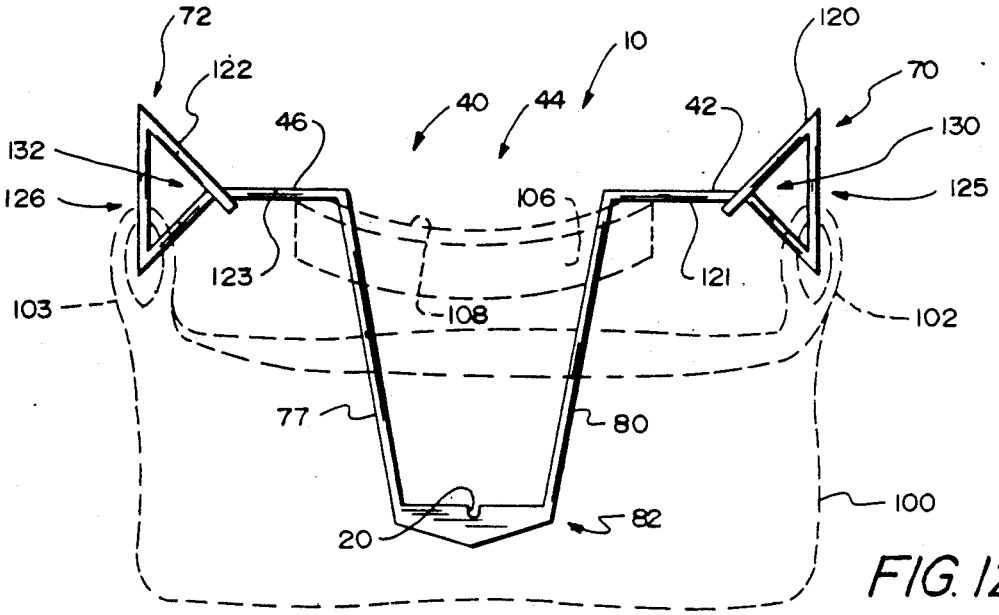
FIG. 12 illustrates another embodiment of the present invention.

FIG. 6 illustrates the tongue adjusting means 85 for enabling the tongue 77 to be axially moved relative to the first end 42 of the elongated body 40 to enable the elongated body to be positioned away from an adjacent cabinet door such that the adjacent cabinet door may be opened or closed without interference from the bag holder. Preferably, the tongue adjusting means 85 includes a rail 86 which slidably fits into a channel 87 to permit axial movement along the elongated body 40, i.e. between the first end 42 and second end 46 of the elongated body 40. A channel 87 may be formed at either the top of the elongated body 48 or the bottom of the elongated body 50 or at both the top and bottom of the elongated body 40. Tongue adjusting means 85 also enables tongue interchangability thereby enabling the holder to be used in combination with a top edge 111 of a cabinet door 105, or the like, by using an "L" shaped 78 tongue 77 (a flat hook shape), as illustrated at FIG. 9; a shelf having an front edge 112, or the like, by using a "C" shaped 79 tongue 77, as illustrated at FIG. 8; a handle 106 having a finger receiving opening 108, or the like, by using a straight 80 tongue 77; or a handle 109 having a shaft 110, or just a shaft, such as shaft 110 without a handle portion such as 109, so as to include a nail partially driven into a wall, and the like, by using a tongue having a hanging means 82, such as a hooked shaped opening 83 as illustrated at FIG. 7A or a notch 20 as illustrated at FIG. 12. Where the tongue is "C" shaped, the tongue may further include a rotating means, such as a hinge pin, to enable the elongated body to be pivoted to a horizontal position when the tongue is attached to the side of a door, or the like, and therefore in a horizontal position (not shown).

Where the flat shaped 80 tongue 77 is resilient 81 and the elongated body 40 and the resilient tongue 81 each further include a center portion 45,84, respectively, with a groove 92 formed therein and extending along the center portion 45 of the elongated body and the center portion 84 of the resilient tongue. The groove 92 enables in use the bag holder to be grippingly and frictionally received into the finger opening 108 of the cabinet door handle 106 such that the groove 92 receives the cabinet door handle 106 thereby securing the bag holder to the cabinet door handle, as illustrated at FIG. 7. The elongated body may be resilient.

Preferably, the first 70 and second 72 bag grip receiving means define a first 74 and a second 75 center-opened slot, respectively, to grippingly receive in use a portion of the hand grip 102,103 of the bag 100. Preferably, the first and second center-opened slots are offset or chamfered 74A,75A, respectively, to permit entry of the hang grips into each respective slot when the holder is against a flat surface, such as a wall, and the like. This is especially advantageous where the holder is in a fixed position by a champing means, such as a clamp.

Figure 10:
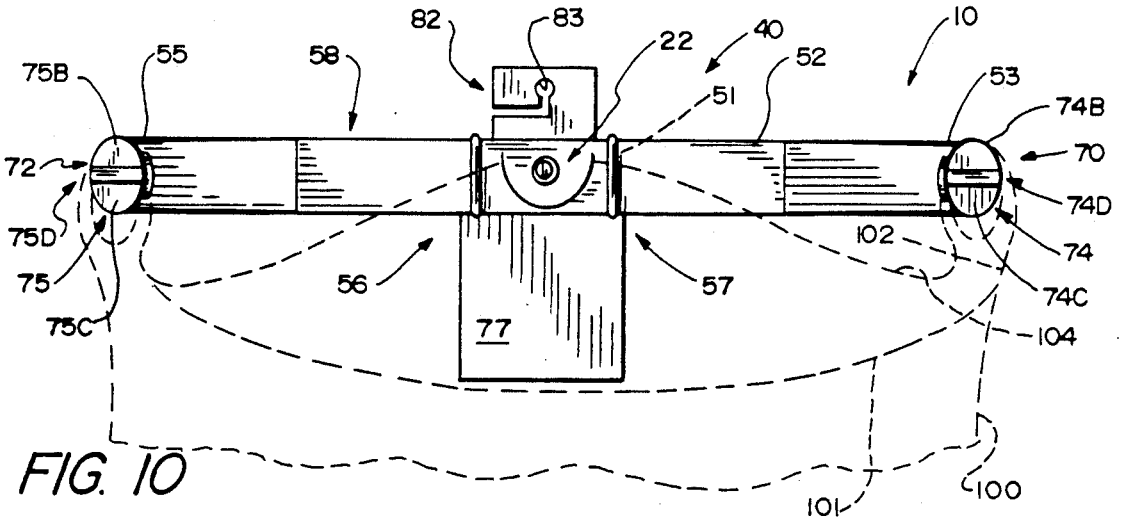
FIG. 10 illustrates another embodiment of the present invention, wherein the elongated body is an arc shaped bar.
Figure 11:
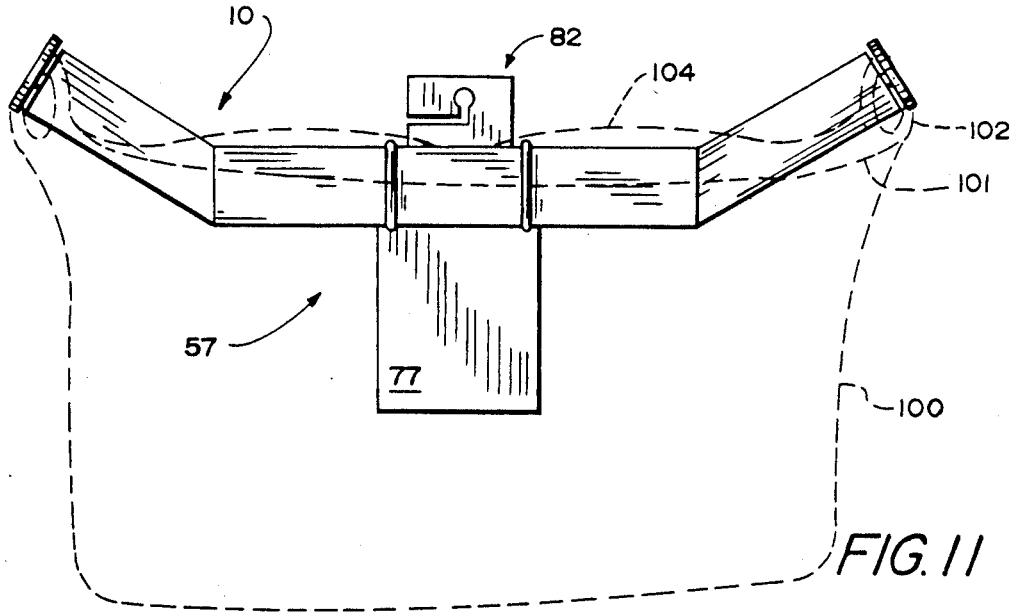
FIG. 11 illustrates the arc shaped bar of FIG. 10 pivoted to a vertical position.

In another embodiment of the invention, as illustrated at FIG. 10, the elongated body 40 is an arc shaped bar 52 having a first end 53, a mid-line 54 and a second end 55. Preferably, the first 70 and second 72 bag grip receiving means define a first 74 and a second 75 center-opened slot, respectively, to grippingly receive in use a portion of the hand grip 102,103 of the bag 100. Preferably, the arc shaped bar 52 includes a pivoting means 57 which enables the arc shaped bar 52 to pivot relative to the tongue 77 between a horizontal position 56 and a vertical position. In use the pivoting means 57 enables the arc shaped bar to be in a horizontal position 56, as illustrated at FIG. 10, to aid in maintaining the bag 100 in an open position to facilitate the placing of objects therein and to allow the arc shaped bar to be pivoted to a vertical position 57, as illustrated at FIG. 11, to decrease the intrusion of the arc shaped bar into the workplace and to aid in retaining the objects placed into the bag, i.e. closing the opening of the bag 100. For convenience, the arc shaped bar 52 preferably includes a spring means 51 to bias the arc shaped bar 52 to a vertical position 57. The arc shaped bar may further include an extending means to enable the first end 53 and/or second end to extend relative to said mid-line 54 such that in use when the first hand grip of the bag is received by the first bag grip receiving means and the second hand grip of the bag is received by the second bag grip receiving means the distance separating the first and the second bag grip receiving means may be varied to maintain the opening of the bag in an open position to facilitate the placing of objects therein and to accommodate in use different sizes of bags. The extending means for the arc shaped bar includes the threaded bore and threaded shaft as illustrated at FIGS. 5 and 5B. However, a means for preventing unintended rotation of the threaded shaft, i.e. the end(s) 53,55, once the desired extension the is attained, such as a locking nut which may be turned against the mid-line portion of the arc shaped bar, is required.

The bag holder 10 may further include a mid-bag securing means 22 positioned on either the elongated body or the tongue for holding in use a portion of the bag which is in about the same horizontal plane as the hand grip of the bag such that in use the opening of the bag through which objects are placed into the bag is better defined. That is, the mid-bag securing means 22 enables the back portion 104 of the bag 100 to be secured which allows the front portion 101 of the bag 100 to hang down, as illustrated at FIGS. 1 and 5. This makes the location of the interior of the bag easier to find for the placement of objects therein.

FIG. 12 illustrates another embodiment of the present invention having an elongated body 40 having a first end 42, a mid-portion 44 and a second end 46 with a tongue 77 having a straight or flat shape 80 positioned at the mid-portion 44 of the body 40 which enables the holder 10 to be slideably received in use into the finger opening 108 of the cabinet door handle 106 for securing the bag holder to the cabinet door (not shown), or the like. The hanging means 82, preferably, a notch 20, enables the holder illustrated at FIG. 12 to be turned 180 degrees and securely hung from a handle 109 having a shaft 110, as shown at FIG. 7A, or just a shaft, such as shaft 110 without a handle portion such as 109, so as to include a nail partially driven into a wall or the like. The first 70 and a second 72 bag grip receiving means secure the hand grip of the bag 100 positioned at the first 42 and the second 46 end, respectively of the elongated body. The purpose of the first and second bag grip receiving means 70,72 is to provide complete support for the bag 100 where the holder is placed in any one of a plurality of positions. Thus, the first and second bag grip receiving means secure and support the bag where the holder is in a vertical position, such as at FIGS. 4, 5, 7 and 7A or in any position therebetween, such as a horizontal position or an angled position, i.e. defining a plurality of positions. The advantage of receiving means 70,72 may be pictured where the holder is secured to an oven door which swings down 90 degrees from vertical. The holder according to the present invention secures the bag thereto notwithstanding whether the oven door is opened (horizontal) or closed (vertial) or in between (angled) those positions. And in the event the oven door fell completely open, i.e. opened 180 degrees, as long as the holder 10 is secured to a surface, e.g. by a nail body, adhesive or the like, the holder 10 will securely retain the bag. Preferably, the first 70 and second 72 bag grip receiving means each comprise an open-loop 125,126 respectively. Most preferably, each open-loop includes a tensioned entry point 130,132, respectively, that is with legs 120,122 being tensioned against legs 121,123, respectively, to define a tensioned open-loop which permits an intended passage, i.e. by intentionally moving a portion of each respective hand grip of bag 100 through the tensioned entry point 130,132 and either into or out of the open-loop. The tensioned entry point aids in retaining the hand grip within the loop notwithstanding whether the holder is hung from a nail or held in the finger opening 108 of the cabinet door handle 106, i.e. where the holder is in a vertical position or in any position therebetween, such as a horizontal position or an angled position. The first 70 and second 72 bag grip receiving means of the holders described at FIGS. 1 and 5 each include a tensioned open-loop defined. above. This enables the bag 100 to be supported such that in use the bag is secured and supported notwithstanding the securing position of the holder, i.e. the holder may be in a hanging position such as where the apex 136 of the tongue is held by a nail or in a "held" position (such as in FIG. 12). Legs 121,123 preferably bend out from the plane of the paper of FIG. 12 in order to position the first 70 and second 72 bag grip receiving away from the surface of the cabinet door, or the like, to aid in the positioning of the hand grip into the open-loop and to engage the handle where the finger opening is otherwise too wide and/or too long such that the legs 121,123 would not engage the handle unless bent.

The present disclosure includes that contained in the appended claims as well a that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A bag holder for use with a bag having at least one hand grip for cooperation with a cabinet door handle secured to a cabinet door, said bag holder comprising:

a resilient body having a first and a second end;

an aperture formed between said first end of said resilient body and said second end of said resilient body such that in use a portion of the cabinet door handle passes through said aperture which enables said resilient body when stretched into position about the cabinet door handle to grip a portion of the cabinet door handle;

a first and a second bag grip receiving means positioned at said first and said second end, respectively, of said resilient body for securely and supportingly receiving the hand grip of the bag; and means for frictionally engaging the cabinet door handle to aid in retaining the bag holder in use on the cabinet door handle when the bag holder is positioned on the cabinet door handle.

2. The bag holder of claim 1 wherein said means for frictionally engaging the cabinet door handle comprises a plurality of bosses extending in use to engage the cabinet door handle as the bag holder is being moved off the cabinet door handle to prevent in use unintended removal of the bag holder from the cabinet door handle.

3. The bag holder of claim 1 further including a mid-bag securing means positioned on said resilient body for holding in use a portion of the bag which is in the same horizontal plane as the hand grips of the bag such that in use the bag is held open to facilite the placing of objects therein.

4. The bag holder of claim 1 wherein each said first and second bag grip receiving means defines a first and a second center-opened slot, respectively, to grippingly receive in use a portion of the hand grip of the bag.

5. The bag holder of claim 4 wherein each said first and said second center-opened slots are chamfered to permit entry of the hang grips into each respective slot when the holder is tightly positioned against a flat surface.

6. The bag holder of claim 1 wherein said resilient body further includes a mid-portion which includes a notch formed thereat to receive in use the shaft of the cabinet door handle when the bag holder is receive by the cabinet door handle.

7. A bag holder for use with a bag having at least one hand grip for cooperation with a cabinet door handle secured to a cabinet door, said bag holder comprising:

a resilient body having a first and a second end;

an aperture formed between said first end of said resilient body and said second end of said resilient body such that in use a portion of the cabinet door handle passes through said aperture which enables said resilient body when stretched into position about the cabinet door handle to grip a portion of the cabinet door handle;

a first and a second bag grip receiving means positioned at said first end and said second end, respectively, of said resilient body wherein each said first and second bag grip receiving means defines a first and a second center-opened slot, respectively, to grippingly receive in use a portion of the hand grip of the bag with each said first and said second center-opened slots being chamfered to permit entry of the hang grips into each respective slot when the holder is tightly positioned against a flat surface;

a mid-bag securing means positioned on said resilient body for holding in use a portion of the bag which is in the same horizontal plane as the hand grips of the bag such that in use the bag is held open to facilitate the placing of objects therein; and means for frictionally engaging the cabinet door handle comprising a plurality of bosses extending in use to engage the cabinet door handle as the bag holder is being moved off the cabinet door handle to prevent in use unintended removal of the bag holder from the cabinet door handle when the bag holder is positioned on the cabinet door handle.

8. The bag holder of claim 7 wherein said resilient body further includes a mid-portion which includes a notch formed thereat to receive in use the shaft of the cabinet door handle when the bag holder is received by the cabinet door handle.

* * * * *